US008948624B2

(12) United States Patent
Mukai et al.

(10) Patent No.: US 8,948,624 B2
(45) Date of Patent: Feb. 3, 2015

(54) FIXING DEVICE AND IMAGE FORMING APPARATUS PROVIDED WITH FIXING DEVICE

(75) Inventors: Kan Mukai, Osaka (JP); Yoshiharu Yoneda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 292 days.

(21) Appl. No.: 13/356,911

(22) Filed: Jan. 24, 2012

(65) Prior Publication Data

US 2012/0201550 A1 Aug. 9, 2012

(30) Foreign Application Priority Data

Feb. 9, 2011 (JP) ..... 2011-026192

(51) Int. Cl.
*G03G 15/20* (2006.01)

(52) U.S. Cl.
CPC ..... *G03G 15/2046* (2013.01); *G03G 15/2039* (2013.01)
USPC ..... 399/33; 399/69; 399/328; 399/334

(58) Field of Classification Search
USPC ..... 399/33, 69, 70, 328–331, 334
See application file for complete search history.

(56) References Cited

U.S. PATENT DOCUMENTS

| | | | | |
|---|---|---|---|---|
| 7,574,165 | B2 | 8/2009 | Mitsuoka et al. | |
| 2005/0185977 | A1* | 8/2005 | Kamei | 399/69 |
| 2006/0204265 | A1* | 9/2006 | Yoshikawa | 399/69 |
| 2007/0036594 | A1 | 2/2007 | Mitsuoka et al. | |
| 2007/0047984 | A1 | 3/2007 | Sanekata | |
| 2007/0059002 | A1* | 3/2007 | Yamamoto et al. | 399/45 |
| 2009/0097891 | A1* | 4/2009 | Bae | 399/329 |

FOREIGN PATENT DOCUMENTS

| | | |
|---|---|---|
| JP | 07-199748 | 8/1995 |
| JP | 11-242405 | 9/1999 |
| JP | 2004-013058 | 1/2004 |
| JP | 2005-099626 | 4/2005 |
| JP | 2007-57758 A | 3/2007 |
| JP | 2007-256633 | 10/2007 |
| JP | 2009-282289 | 12/2009 |
| JP | 2010-256478 | 11/2010 |

* cited by examiner

*Primary Examiner* — Walter L Lindsay, Jr.
*Assistant Examiner* — Jessica L Eley
(74) *Attorney, Agent, or Firm* — Renner, Otto, Boisselle & Sklar, LLP

(57) ABSTRACT

A fixing device includes a fixing roller, a single heating member that heats the fixing roller, a pressure roller, a first temperature detecting element that detects the temperature of the contact region, of the fixing roller, that comes into contact with the recording paper transported, and a second temperature detecting element that detects the temperature of the noncontact region of the fixing roller. The fixing device carries out energization control of the heating member based on the temperature detected by the first temperature detecting element and stops energization control of the heating member when the temperature detected by the second temperature detecting element reaches a prescribed temperature.

6 Claims, 6 Drawing Sheets

FIXING DEVICE AND IMAGE FORMING APPARATUS PROVIDED WITH FIXING DEVICE

CROSS-REFERENCE TO RELATED APPLICATION

This application claims priority under 35 U.S.C. §119(a) on Patent Application No. 2011-026192 filed in Japan on Feb. 9, 2011, the entire contents of which are herein incorporated by reference.

FIELD OF THE INVENTION

The present invention relates to fixing devices that fix toner images formed on paper, and to image forming apparatuses provided with these fixing devices.

RELATED ART

This type of fixing device, which is applied in image forming apparatuses that use methods such as electrography, electrostatic recording, and magnetography or the like, sandwiches a paper (such as plain paper, electrostatic recording paper, and photographic paper or the like) on which a toner image has been formed in a nip region between a fixing roller (also referred to as a heating roller) and a pressure roller, thereby applying heat and pressure to fix the toner image onto the paper.

In these fixing devices, the paper center for example is aligned with the center of a nip region between the fixing roller and the pressure roller for the paper to pass through the nip region. In this case, the heat quantity near the center of the fixing roller is taken up by the paper such that the temperature near the center of the fixing roller drops, and furthermore there are few opportunities for the areas near the ends of the fixing roller to contact the paper such that there is a tendency for the temperatures near the ends of the fixing roller to become higher than the temperature near the center, and only the areas near the ends of the fixing roller tend to overheat.

For this reason, technologies have been proposed in which multiple heaters are arranged inside the fixing roller, and the area near the center of the fixing roller and the areas near the ends are heated by respective heaters, thereby reducing the temperature difference between the areas near the center and near the ends of the fixing roller. However, providing multiple heaters and controlling these heaters separately involves increasing the number of components and making the control thereof more complex.

Accordingly, in a technology described in JP 2004-013058A, a single lamp heater is provided inside the fixing roller and the fixing roller is heated by this single lamp heater only, and a temperature near the center and a temperature near an end of the fixing roller are detected by a first and second thermistor respectively, and the temperature of the fixing roller is controlled by carrying out energization control of the lamp heater based on the temperature near the center of the fixing roller detected by the first thermistor. Furthermore, in the technology described in JP 2004-013058A, in a case where the temperature near the end portion of the fixing roller detected by the second thermistor has reached a heat resistance temperature of a shaft bearing (made of resin) of the fixing roller, overheating of the fixing roller is prevented by stopping the energization of the lamp heater.

However, in JP 2004-013058A, even though energization of the lamp heater is controlled and stopped based on the temperature detected by the first and second thermistors, no consideration is given to a countermeasure for when this heater control becomes erratic, and it does not suitably nor reliably prevent the heater control from becoming erratic.

Furthermore, although the energization of the lamp heater is stopped when the temperature near the end of the fixing roller detected by the second thermistor reaches the heat resistance temperature of the shaft bearing (made of resin) of the fixing roller, thereby preventing overheating of the fixing roller, since the heat resistance temperatures vary greatly depending on the type of resin thereof, setting the heat resistance temperature of the resin as the temperature of when to stop the energization of the lamp heater cannot be considered favorable to image forming operations in an image forming apparatus.

Accordingly, the present invention has been devised in consideration of these issues, and it is an object thereof to provide a fixing device in which it is possible to suitably prevent the heater control for heating the fixing roller from becoming erratic, and in which a temperature that does not hinder the image forming operations of an image forming apparatus is set as the temperature of when the energization of the heater is stopped and an image forming apparatus provided with this fixing device.

SUMMARY OF THE INVENTION

In order to address these issues, a fixing device according to the present invention including a fixing roller, a single heating member that heats the fixing roller, a pressure roller that is pressed against the fixing roller, a first temperature detecting element that detects a temperature of a contact region of the fixing roller that comes into contact with a paper transported sandwiched between the fixing roller and the pressure roller, and a second temperature detecting element that detects a temperature of a noncontact region of the fixing roller that is outside the contact region, wherein energization control of the heating member is carried out based on a temperature detected by the first temperature detecting element, and energization control of the heating member is stopped when a temperature detected by the second temperature detecting element reaches a prescribed temperature, the fixing device further including a conduction shutoff portion that, in a case where the temperature of the contact region of the fixing roller has reached an upper limit temperature that is higher than the prescribed temperature, senses the upper limit temperature and shuts off the energization of the heating member, wherein, in a state in which a center position of the paper in an axial direction of the fixing roller has been aligned with a reference position of the fixing roller, the paper is transported sandwiched between the fixing roller and the pressure roller, and the first temperature detecting element and the conduction shutoff portion are arranged in a symmetrical manner with respect to the reference position.

In the fixing device according to the present invention, the fixing roller is heated by a single heating member, and energization control of the heating member is carried out based on temperatures by the first and second temperature detecting elements, but a countermeasure is necessary for when control of the heating member becomes erratic. Accordingly, in the fixing device according to the present invention, a center position of the paper in the axial direction of the fixing roller is aligned with a reference position of the fixing roller, and the first temperature detecting element and the conduction shutoff portion are arranged in a symmetrical manner with respect to the reference position. Consequently, the position where the temperature of the fixing roller is detected by the first temperature detecting element and the position where the temperature of the fixing roller is sensed by the conduction shutoff portion have a symmetrical relationship with respect to the position at which the center of the paper passes. And since the temperature of the contact region of the fixing roller contacting the paper is detected by the first temperature detecting element, the temperature of the contact region of the fixing roller contacting the paper is sensed also by the conduction shutoff portion. For this reason, accompanying fixing processing of the paper, the temperature of the fixing roller detected by the first temperature detecting element and the temperature of the fixing roller sensed by the conduction shutoff portion always fluctuate in an equivalent manner and are substantially same values. Thus, when control of the heating member becomes erratic and the temperature of the fixing roller detected by the first temperature detecting element rises to the upper limit temperature, the temperature of the fixing roller sensed by the conduction shutoff portion also rises to the upper limit temperature, and the upper limit temperature is sensed immediately by the conduction shutoff portion such that energization of the heating member is stopped with a suitable timing.

Furthermore, in the fixing device according to the present invention, it is preferable that the conduction shutoff portion is a thermostat inserted to a power line of the heating member.

Furthermore, in the fixing device according to the present invention, it is preferable that a softening temperature or a melting temperature of a shaft bearing of the fixing roller is equal to or less than the upper limit temperature and higher than the prescribed temperature.

In this case, even though the fixing roller reaches the prescribed temperature, operation of the fixing device is possible without softening or melting of the shaft bearings of the fixing roller. Furthermore, when the temperature of the fixing roller exceeds the prescribed temperature and continues to rise toward the upper limit temperature, the shaft bearings of the fixing roller soften or melt such that the fixing roller approaches or contacts the conduction shutoff portion and the upper limit temperature is reliably sensed by the conduction shutoff portion such that energization of the heating member is reliably stopped.

Next, an image forming apparatus according to the present invention includes a fixing device that includes a fixing roller, a single heating member that heats the fixing roller, a pressure roller that is pressed against the fixing roller, a first temperature detecting element that detects a temperature of a contact region of the fixing roller that comes into contact with a paper transported sandwiched between the fixing roller and the pressure roller, and a second temperature detecting element that detects a temperature of a noncontact region of the fixing roller that is outside the contact region, and in which energization control of the heating member is carried out based on a temperature detected by the first temperature detecting element, and energization control of the heating member is stopped when a temperature detected by the second temperature detecting element reaches a prescribed temperature; and a paper feeding cassette that accommodates a specific number of sheets of paper to be in a full state, wherein a toner image is formed on paper supplied from the paper feeding cassette and heat and pressure are applied to the paper by the fixing device such that the toner image is fixed to the paper, and wherein a temperature higher than the temperature reached at the noncontact region of the fixing roller when, while energization control of the heating member is maintained, the toner images on the specific number of sheets of paper supplied consecutively from the paper feeding cassette are fixed continuously is set as the prescribed temperature of when energization control of the heating member is to be stopped.

In the image forming apparatus according to the present invention, a temperature higher than the temperature reached at the noncontact region of the fixing roller when, while energization control of the heating member is maintained, the toner images on all the papers supplied consecutively from the paper feeding cassette in a full state are fixed continuously is set as the prescribed temperature of when energization control of the heating member is to be stopped. For this reason, the temperature detected by the second temperature detecting element (temperature of the noncontact region) does not reach the prescribed temperature until the fixing of all the papers supplied from the paper feeding cassette in a full state is completed, and thus fixing of the papers can continue without any stopping of the energization control of the heating member. Furthermore, even though energization control of the heating member is stopped after the fixing of all the papers supplied from the paper feeding cassette in a full state has been completed, at this time there is a necessity to refill papers into the paper feeding cassette and the temperature of the fixing roller drops during this refilling operation, and therefore fixing of papers can recommence immediately after this refilling operation has been completed.

Furthermore, in the image forming apparatus according to the present invention, after the energization control of the heating member has been stopped, a transport operation of paper by the fixing roller and the pressure roller may continues.

In this case, the fixing roller and the pressure roller continue to rotate, and therefore a flow of air is produced around the rollers, and the temperatures of the rollers drop swiftly due to this flow of air.

DESCRIPTION OF THE PREFERRED EMBODIMENTS

Hereinafter, embodiments of the present invention are described in detail with reference to the accompanying drawings.

Figure 1:
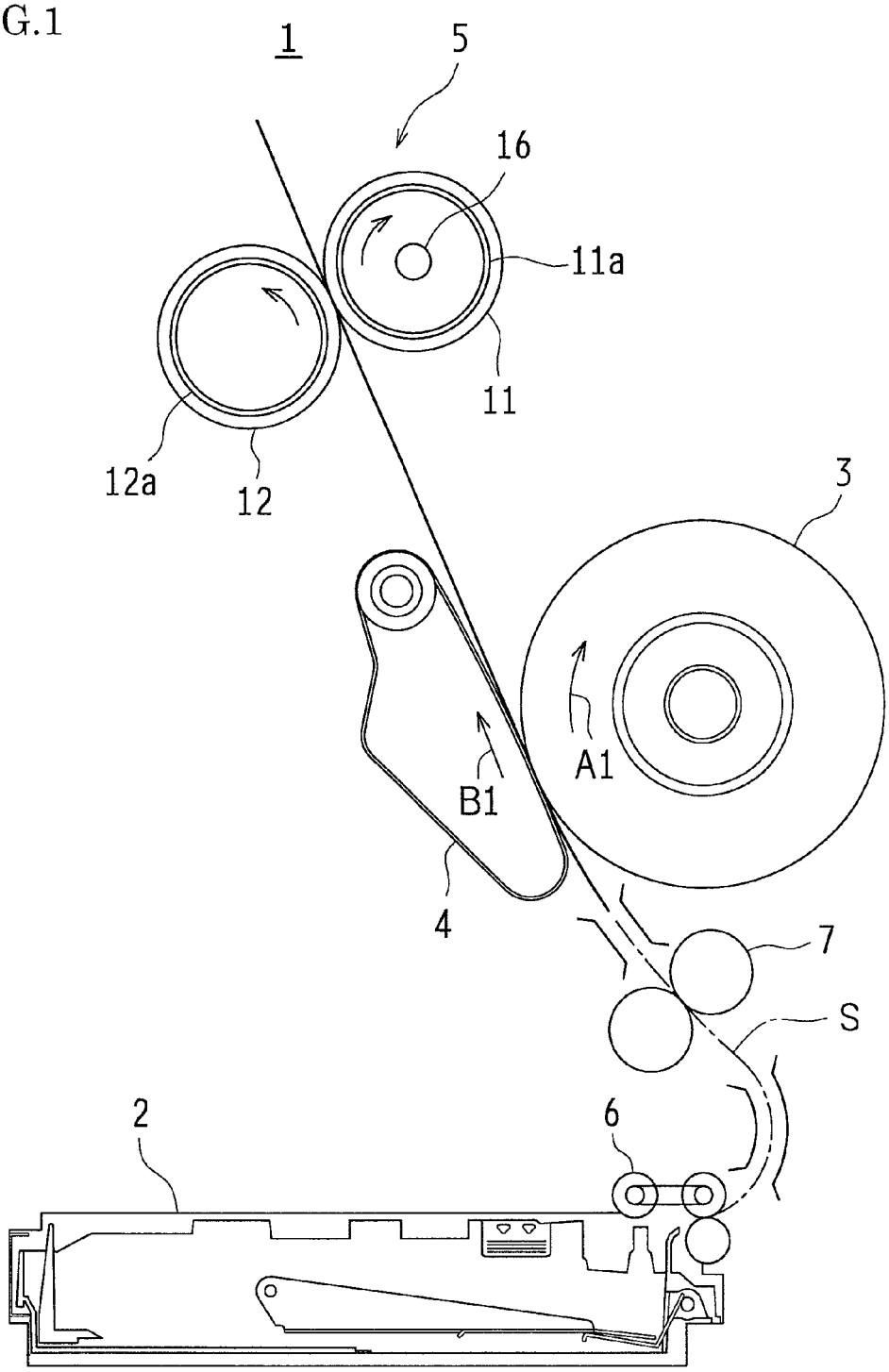
FIG. 1 is a cross-sectional view showing principal portions of an image forming apparatus in which one embodiment of a fixing device according to the present invention has been applied.

FIG. 1 is a cross-sectional view showing principal portions of an image forming apparatus in which one embodiment of a fixing device according to the present invention has been applied. An image forming apparatus 1 forms a toner image onto a recording paper using an electrographic method and is provided with components such as a paper feeding cassette 2, a photosensitive drum 3, a transfer belt 4, and a fixing device 5.

The photosensitive drum 3 has a photosensitive layer on its surface and is rotationally driven in the direction of arrow A1 at a fixed rotational velocity. Accompanying rotation of the photosensitive drum 3, the surface of the photosensitive drum 3 is charged uniformly to a predetermined electric potential by a charging device (not shown in drawings), an electrostatic latent image is formed on the surface of the photosensitive drum 3 by an exposure device (not shown in drawings), and the electrostatic latent image on the surface of the photosensitive drum 3 is developed into a toner image by a development device (not shown in drawings).

The transfer belt 4 is driven and orbitally moves in the direction of arrow B1 at the same velocity as the surface velocity of the photosensitive drum 3 and presses against the photosensitive drum 3 such that a nip region forms therebetween. A recording paper that is transported in from the paper feeding cassette 2 below is introduced to the nip region, and a toner image on the surface of the photosensitive drum 3 is transferred onto the recording paper while the recording paper is transported in the nip region. A high voltage transfer bias (a high voltage that has opposite polarity (+) to the charge polarity (−) of the toner) is applied to the transfer belt 4 to achieve transfer of the toner image.

After the toner image is transferred at the nip region between the photosensitive drum 3 and the transfer belt 4, the recording paper is again transported upward and introduced to the fixing device 5. The fixing device 5 is provided with a fixing roller (also referred to as a heating roller) 11 and a pressure roller 12. The fixing roller 11 and the pressure roller 12 press against each other to form a nip region therebetween, and the fixing roller 11 is rotationally driven, and the pressure roller 12 rotates idly. The paper that is transported in is sandwiched in the nip region between the rollers 11 and 12 so as to be subjected to heat and pressure, thereby fixing the toner image onto the paper.

Furthermore, a paper pickup roller 6 is provided at an end portion of the paper feeding cassette 2, and recording papers are withdrawn sheet by sheet from the paper feeding cassette 2 by this paper pickup roller 6 to be transported to a paper transport path S.

Arranged along the paper transport path S are components such as paper registration rollers 7, the photosensitive drum 3, the transfer belt 4, and the fixing device 5. The paper registration rollers 7 transports the recording papers, after temporarily stopping the recording paper that has been transported in, and then, aligning the leading edge of the recording paper, well timed with the rotations of the photosensitive drum 3 and the transfer belt 4 so that the toner image on the photosensitive drum 3 is transferred to the recording paper at the nip region between the photosensitive drum 3 and the transfer belt 4. The recording paper passes through the nip region between the photosensitive drum 3 and the transfer belt 4, then is transported upward after further passing through the nip region between the fixing roller 11 and the pressure roller 12, and is then discharged to a discharge tray or the like (not shown in drawing).

Figure 2:
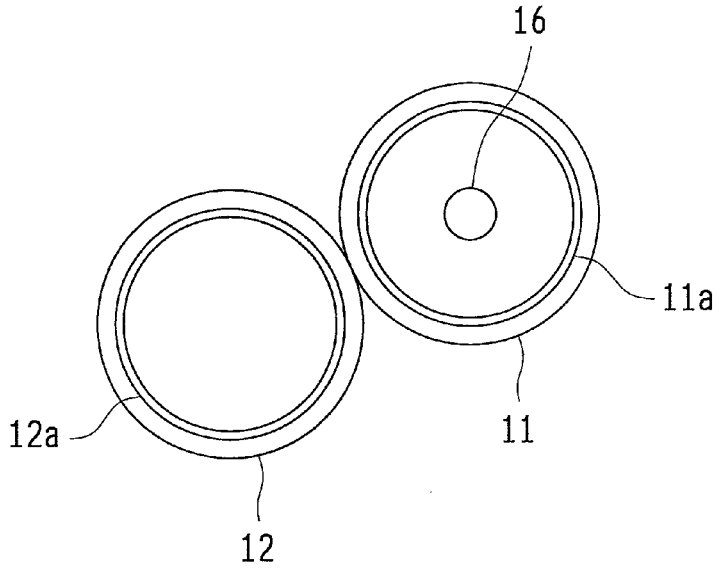
FIG. 2 is a cross-sectional view that schematically shows the fixing device according to the present embodiment.
Figure 3:
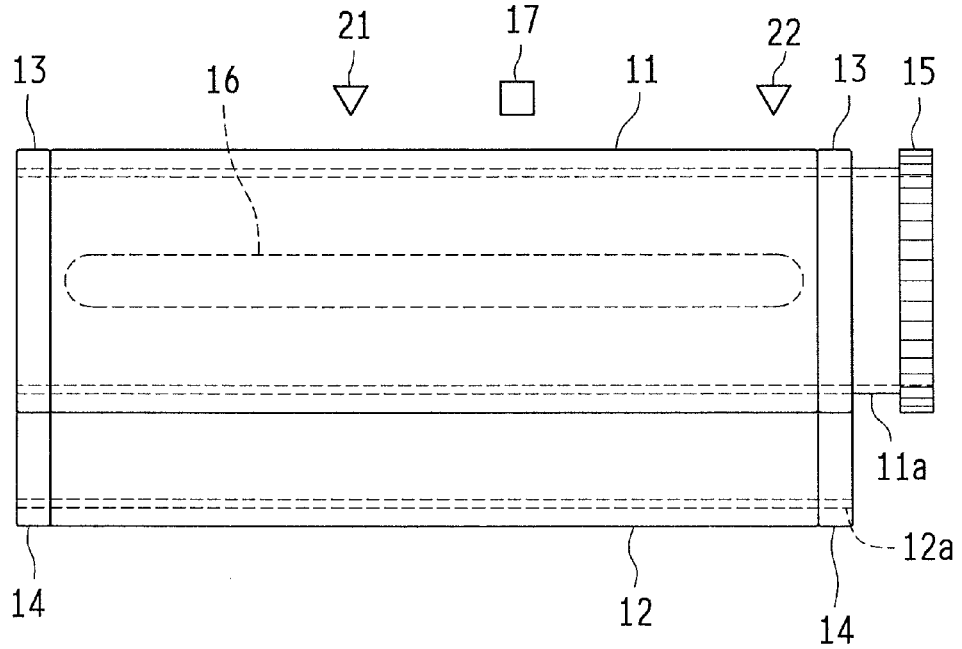
FIG. 3 is a front view that schematically shows the fixing device of FIG. 2.

Next, detailed description is given of the fixing device 5 in the image forming apparatus 1. FIG. 2 is a cross-sectional view that schematically shows the fixing device 5, and FIG. 3 is a front view that schematically shows the fixing device 5.

In the fixing device 5, each of the two end portions of a rotating shaft 11*a* of the fixing roller 11 is supported by a shaft bearing 13 made of a synthetic resin, and each of the two end portions of a rotating shaft 12*a* of the pressure roller 12 is supported by a shaft bearing 14 made of a synthetic resin. Furthermore, the synthetic resin shaft bearings 13 of the fixing roller 11 and the synthetic resin shaft bearings 14 of the pressure roller 12 are supported so as to readily connect to and disconnect from each other, and the synthetic resin shaft bearings 14 of the pressure roller 12 are biased by a spring (not shown in drawings) toward the synthetic resin shaft bearings 13 of the fixing roller 11, such that the fixing roller 11 and the pressure roller 12 press against each other and a nip region is formed between the fixing roller 11 and the pressure roller 12.

Furthermore, a gear 15 having a same axis as the rotating shaft 11*a* is secured to one end portion of the rotating shaft 11*a* of the fixing roller 11, and a drive gear (not shown in drawings) on the image forming apparatus 1 side meshes with the gear 15 such that the rotation of the drive gear is transmitted to the gear 15, thereby causing the fixing roller 11 to rotate, and causing the pressure roller 12 that presses against the fixing roller 11 to be idly rotated.

The fixing roller 11 is a roller having a three-layer structure in which an elastic layer is provided on an outer surface of the hollow tubular rotating shaft 11*a* for example and a mold release layer is formed on an outer surface of the elastic layer. In a same manner as the fixing roller 11, the pressure roller 12 is also a roller having a three-layer structure in which an elastic layer is provided on an outer surface of the hollow tubular rotating shaft 12*a* and a mold release layer is formed on an outer surface of this elastic layer.

A single heater lamp (halogen lamp) 16, which is a heating member that heats the roller 11, is provided inside the rotating shaft 11*a* of the fixing roller 11. The heater lamp 16 is a rod shaped component that extends in a lengthwise direction of the fixing roller 11 and heats substantially all of the fixing roller 11. And the heat of the fixing roller 11 is transmitted to the pressure roller 12 that presses against the fixing roller 11, thereby also heating the pressure roller 12. Both the fixing roller 11 and the pressure roller 12 are hollow tubular rollers having a three-layer structure, and the thicknesses of the peripheral walls of these are made thin, thereby keeping low the heat quantity of the peripheral walls. For this reason, the peripheral wall of the fixing roller 11 is readily heated by the heater lamp 16, and the pressure roller 12 is also readily heated by the fixing roller 11 such that the surface temperature of the fixing roller 11 rises to a fixing temperature in a short time, and the standby time from when the heater lamp 16 is turned on until fixing processing commences is made short.

Further still, a thermostat 17 and a first thermistor 21 are provided near the center of the fixing roller 11, and a second thermistor 22 is provided near one end portion of the fixing roller 11. The thermostat 17 senses the surface temperature of the fixing roller 11, and switches from on to off when the fixing roller 11 becomes overheated. Furthermore, the first and second thermistors 21 and 22 detect the surface temperature of the fixing roller 11.

Figure 4A:
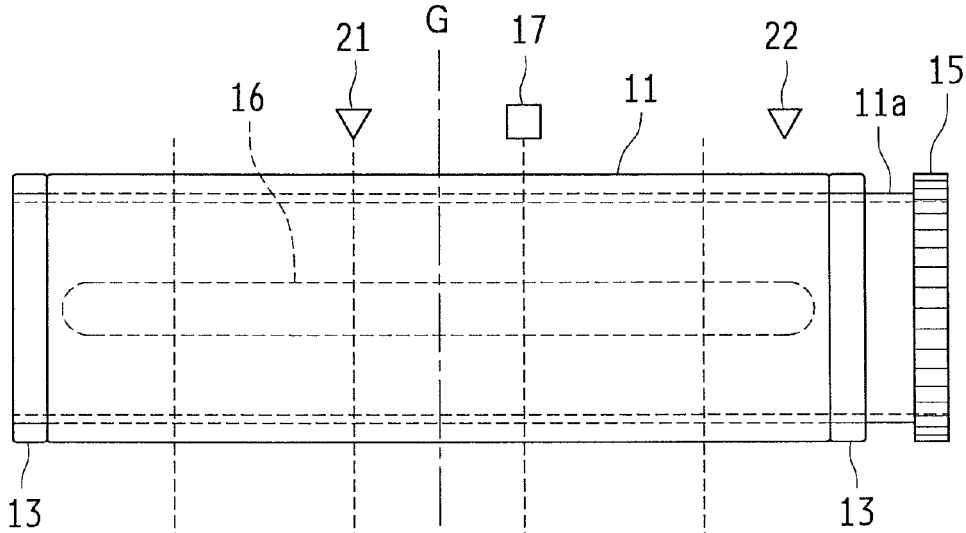
FIG. 4A is a diagram showing positions of a thermostat and first and second thermistors, which are arranged along a fixing roller in the fixing device.
Figure 4B:
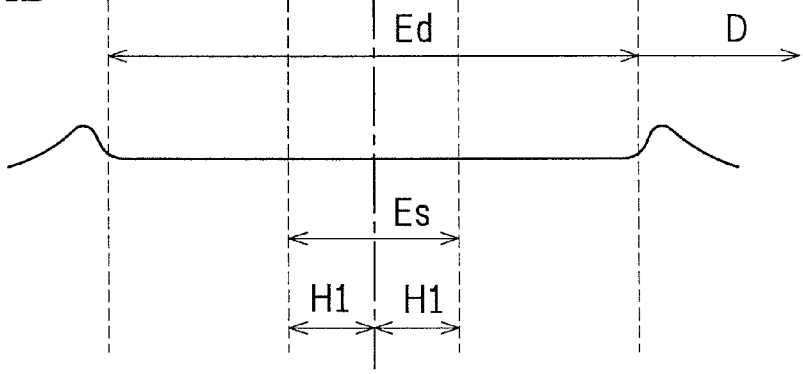
FIG. 4B is a graph showing a surface temperature distribution of the fixing roller in a state corresponding to the positions of the fixing roller shown in FIG. 4A.

Next, detailed description is given regarding the thermostat 17 and the first and second thermistors 21 and 22. FIG. 4A is a diagram showing positions of the thermostat and the first and second thermistors, which are arranged along the fixing roller in the fixing device. FIG. 4B is a graph showing a surface temperature distribution of the fixing roller in a state corresponding to the positions of the fixing roller shown in FIG. 4A.

Here, in the fixing device 5, the recording paper passes through the nip region with a center of the recording paper in the axial direction of the fixing roller 11 being matched to a center (reference position of the fixing roller 11) G of the nip region between the fixing roller 11 and the pressure roller 12 regardless of the size of the recording paper. Accordingly, when the region where the smallest sized recording paper used in the image forming apparatus 1 comes into contact with the rollers 11 and 12 is given as smallest contact region Es, then the center of the smallest contact region Es is matched to the center G of the nip region. Furthermore, when the region where the largest sized recording paper used in the image forming apparatus 1 comes into contact with the rollers 11 and 12 is given as largest contact region Ed, then the center of the largest contact region Ed is matched to the center G of the nip region. The heater lamp 16 is configured such that its length is slightly longer than the width of the largest contact region Ed and so as to be capable of reliably heating the largest contact region Ed of the rollers 11 and 12.

In this manner, regardless of its size, the recording paper always passes through the center G of the nip region between the rollers 11 and 12. For this reason, the heat quantity near the center of the fixing roller 11 is taken up by the recording paper and there is a tendency for the surface temperature to drop near the center of the fixing roller 11. Furthermore, there is a tendency that the probability of the recording paper contacting near the ends of the fixing roller 11 is lowered, and the probability that the heat quantity near the ends of the largest contact region Ed is taken up by the recording paper is also lowered, and also that the surface temperature near the ends of the largest contact region Ed is higher than the surface temperature near the center of the fixing roller 11. As a result, the surface temperature distribution of the fixing roller 11 becomes as shown in the graph of FIG. 4B.

The first thermistor 21 is arranged in the smallest contact region Es and is in contact with the surface of the fixing roller 11 to detect the surface temperature near the center of the fixing roller 11. Furthermore, the second thermistor 22 is arranged in a noncontact region D (near an end portion of the heater lamp 16) away from the largest contact region Ed and is in contact with the surface of the fixing roller 11 to detect the surface temperature of one end portion of the fixing roller 11 that does not contact even a largest sized recording paper.

Furthermore, the thermostat 17 is arranged in a position that is symmetrical to the first thermistor 21 with respect to the center G of the nip region, and is configured to be slightly apart from the surface of the fixing roller 11 such that it is in a noncontact state with the surface of the fixing roller 11. Here, the when the distance from the center G of the nip region to the position of the first thermistor 21 that is apart on one end side of the fixing roller 11 is given as H1, the distance from the center G of the nip region to the position of the thermostat 17 that is apart on the other end side of the fixing roller 11 is also H1. Since this positional relationship is set and the length of the heater lamp 16 is sufficiently longer than the smallest contact region Es such that the smallest contact region Es of the fixing roller 11 is uniformly heated by the heater lamp 16, the temperature of the fixing roller 11 detected by the first thermistor 21 and the temperature of the fixing roller 11 sensed by the thermostat 17 always fluctuate in an equivalent manner and are substantially same values.

Figure 5:
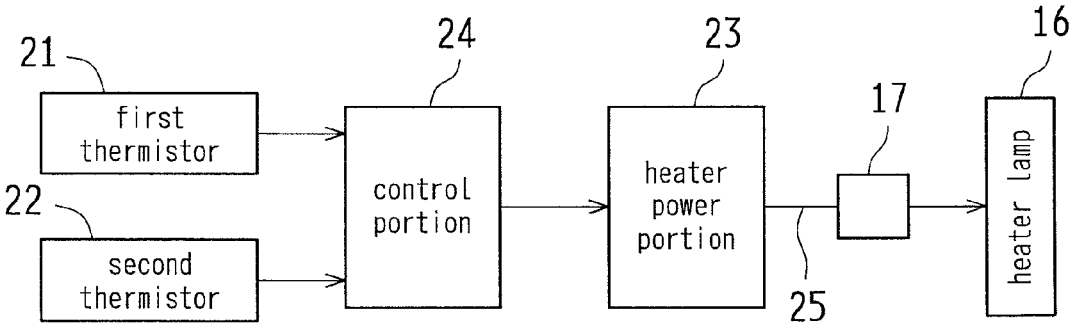
FIG. 5 is a block diagram showing a configuration of a control system of a heater lamp of the fixing roller.

Next, detailed description is given of the energization control of the heater lamp 16 based on the detected temperatures of the first and second thermistors 21 and 22. FIG. 5 is a block diagram showing a configuration of a control system of the heater lamp 16 of the fixing roller 11.

In FIG. 5, a heater power portion 23 is a portion that supplies power pulse signals to the heater lamp 16 and performs PWM control of the power pulse signals, thereby causing the heater lamp 16 to generate heat and varying the quantity of heat generated by the heater lamp 16. A control portion 24 controls the heater power portion 23 to adjust the pulse width (duty ratio) of the power pulse signals. For example, the control portion 24 compares the surface temperature of the smallest contact region Es of the fixing roller 11 detected by the first thermistor 21 and a preset fixing temperature F1 (for example, F1=165° C.), and when the surface temperature of the smallest contact region Es of the fixing roller 11 is lower than the fixing temperature F1, widens the pulse width of the power pulse signal to cause an increase in the quantity of heat generated by the heater lamp 16, thereby raising the surface temperature of the smallest contact region Es of the fixing roller 11. Furthermore, when the surface temperature of the smallest contact region Es of the fixing roller 11 is higher than the fixing temperature F1, the control portion 24 narrows the pulse width of the power pulse signal to cause a decrease in the quantity of heat generated by the heater lamp 16, thereby reducing the surface temperature of the smallest contact region Es of the fixing roller 11. In this way, control is performed so that the surface temperature of the smallest contact region Es of the fixing roller 11 is matched to the prescribed temperature F1.

Furthermore, the control portion 24 compares the surface temperature of the noncontact region D of the fixing roller 11 detected by the second thermistor 22 and a preset prescribed temperature F2 (for example, F2=230° C. and F2>F1), and when the surface temperature of the noncontact region D of the fixing roller 11 is lower than the prescribed temperature F2, continues control of the heater lamp 16 based on the temperature detected by the first thermistor 21, and when the surface temperature of the noncontact region D of the fixing roller 11 reaches the prescribed temperature F2, stops the output of power pulse signals from the heater power portion 23, thereby stopping the heat generation of the heater lamp 16. In this way, the temperature of the fixing roller 11 is prevented from rising abnormally.

Further still, after stopping the output of power pulse signals from the heater power portion 23 and when the temperature detected by the second thermistor 22 drops by a fixed temperature width, the control portion 24 recommences output of the power pulse signals from the heater power portion 23, thereby causing the heater lamp 16 to generate heat so as to recommence the fixing operations of the fixing device 5.

That is, when the surface temperature of the smallest contact region Es of the fixing roller 11 is adjusted to the fixing temperature F1 based on the temperature detected by the first thermistor 21 and the temperature detected by the second thermistor 22 reaches the prescribed temperature F2, energization of the heater lamp 16 is shut off, thereby preventing the temperature of the fixing roller 11 from rising abnormally.

By carrying out energization control and energization shut-off control of the heater lamp 16 in this manner based on the temperatures detected by the first and second thermistors 21 and 22, the surface temperature near the center of the fixing roller 11 is controlled, and overheating of the fixing roller 11 is prevented.

However, in a case where a malfunction occurs in the first and second thermistors 21 and 22 or the like, the control of the heater lamp 16 becomes erratic such that the fixing roller 11 overheats and peripheral components malfunction or melt, and therefore a countermeasure is necessary for when the control of the heater lamp 16 becomes erratic.

Consequently, in the present embodiment, a power line 25 is inserted to the thermostat 17 from the heater power portion 23 to the heater lamp 16 as shown in FIG. 5. The thermostat 17 senses the surface temperature of the smallest contact region Es of the fixing roller 11 (this matches the temperature of the fixing roller 11 detected by the first thermistor 21) and maintains an on state while the sensed surface temperature is less than a preset upper limit temperature F3 (F3>F2>F1) so as to allow the power line 25 to conduct and enabling energization control of the heater lamp 16, and when the sensed surface temperature equals or exceeds the upper limit temperature F3, switches from on to off so as to shut off the power line 25 causing energization control of the heater lamp 16 to stop, thereby preventing control of the heater lamp 16 from becoming erratic.

Specifically, in a state in which control of the heater lamp 16 by the control portion 24 has become erratic, even if the surface temperature of the smallest contact region Es of the fixing roller 11 detected by the first thermistor 21 becomes higher than the upper limit temperature F3, or even if the surface temperature of the noncontact region D of the fixing roller 11 detected by the second thermistor 22 becomes equal to or higher than the prescribed temperature F2, the power pulse signals from the heater power portion 23 continue to be outputted, and therefore the heater lamp 16 continues to generate heat and the temperature of the fixing roller 11 continues to rise. At this time, the thermostat 17 senses the surface temperature of the smallest contact region Es of the fixing roller 11, and when the sensed temperature reaches the upper limit temperature F3, switches from on to off such that the power line 25 is shut off and energization control of the heater lamp 16 is stopped.

As described earlier, the temperature detected by the first thermistor 21 and the temperature sensed by the thermostat 17 always fluctuate in an equivalent manner and are substantially same values, and therefore when the surface temperature of the smallest contact region Es of the fixing roller 11 detected by the first thermistor 21 rises to the upper limit temperature F3 due to control of the heater lamp 16 becoming erratic, the temperature sensed by the thermostat 17 also rises to the upper limit temperature F3. In this case, the upper limit temperature F3 is sensed immediately by the thermostat 17 and the thermostat 17 switches from on to off, and therefore the energization of the heater lamp 16 is stopped with a suitable timing.

Furthermore, the upper limit temperature F3 near the center of the fixing roller 11 for the thermostat 17 to switch from on to off is set equal to or above the softening temperature or the melting temperature of each of the synthetic resin shaft bearings 13 (the softening temperature or the melting temperature of each of the synthetic resin shaft bearings 13 is not greater than the upper limit temperature F3). For this reason, even if the temperature of the thermostat 17 does not rise sufficiently due to heat dissipation from near the center of the fixing roller 11 when the surface temperature near the center of the fixing roller 11 rises to the upper limit temperature F3 so that the thermostat 17 does not switch from on to off, when the temperatures of the end portions of the fixing roller 11 rise to the upper limit temperature F3, the synthetic resin shaft bearings 13 soften or melt due to thermal conduction from the end portions of the fixing roller 11 such that the synthetic resin shaft bearings 13 deform being unable to withstand the contact pressure from the pressure roller 12 to the fixing roller 11, and the fixing roller 11 displaces to an opposite side from the pressure roller 12. And since the thermostat 17 is arranged in a position on an opposite side from the pressure roller 12 with respect to the fixing roller 11, it contacts the fixing roller 11, which has displaced to the opposite side from the pressure roller 12. As a result, the surface temperature of the fixing roller 11 is directly sensed by the thermostat 17 and the sensed temperature of the thermostat 17 reliably rises to the upper limit temperature F3 such that the thermostat 17 switches from on to off, and the energization of the heater lamp 16 is reliably stopped.

Note however that the softening temperature or the melting temperature of the synthetic resin shaft bearings 13 that support the end portions of the rotating shaft 11*a* of the fixing roller 11 are set higher than the prescribed temperature F2 of the end portions of the fixing roller 11 of when the energization control of the heater lamp 16 is stopped. For this reason, even if the temperature of the end portions of the fixing roller 11 reaches the prescribed temperature F2, the end portions of the rotating shaft 11*a* of the fixing roller 11 are supported by the synthetic resin shaft bearings 13 and operation of the fixing device 5 is possible.

Since the first thermistor 21 and the thermostat 17 are arranged symmetrically with respect to the center G of the nip region in this manner, the temperature detected by the first thermistor 21 and the temperature sensed by the thermostat 17 always fluctuate in an equivalent manner, and when the temperature detected by the first thermistor 21 rises to the upper limit temperature F3, the temperature sensed by the thermostat 17 also rises to the upper limit temperature F3 such that the thermostat 17 switches from on to off, and energization of the heater lamp 16 is stopped with a suitable timing.

On the other hand, in the present embodiment, when the temperature detected by the second thermistor 22 reaches the prescribed temperature F2 (for example, F2=230° C.), heat generation by the heater lamp 16 is caused to stop, but when the heat generation by the heater lamp 16 is stopped inadvertently, this results in the fixing operations of the fixing device 5 being interrupted, and therefore the prescribed temperature F2 is set to a temperature that does not hinder the fixing operations of the fixing device 5.

Specifically, as the prescribed temperature F2, a temperature is set that is higher than the temperature reached at the noncontact region D of the fixing roller 11 when, in a state in which heat generation by the heater lamp 16 is continuous, all the toner images on all the recording papers supplied consecutively from the paper feeding cassette 2 in a full state have been fixed continuously by the fixing device 5. In this way, it becomes possible to continuously fix all the recording papers that are accommodated in the paper feeding cassette 2.

For example, if the paper feeding cassette 2 is in a full state when 250 sheets of the largest sized recording paper are accommodated in the paper feeding cassette 2, then a temperature is set as the prescribed temperature F2 (for example, F2=230° C.) that is higher than the temperature (for example, 220° C.) reached at the noncontact region D of the fixing roller 11 when, in a state in which heat generation by the heater lamp 16 is continuous, 250 sheets of recording paper are consecutively supplied from the paper feeding cassette 2 and toner images are transferred and formed on all the recording papers such that the toner images on all the recording papers are fixed continuously by the fixing device 5.

Figure 6:
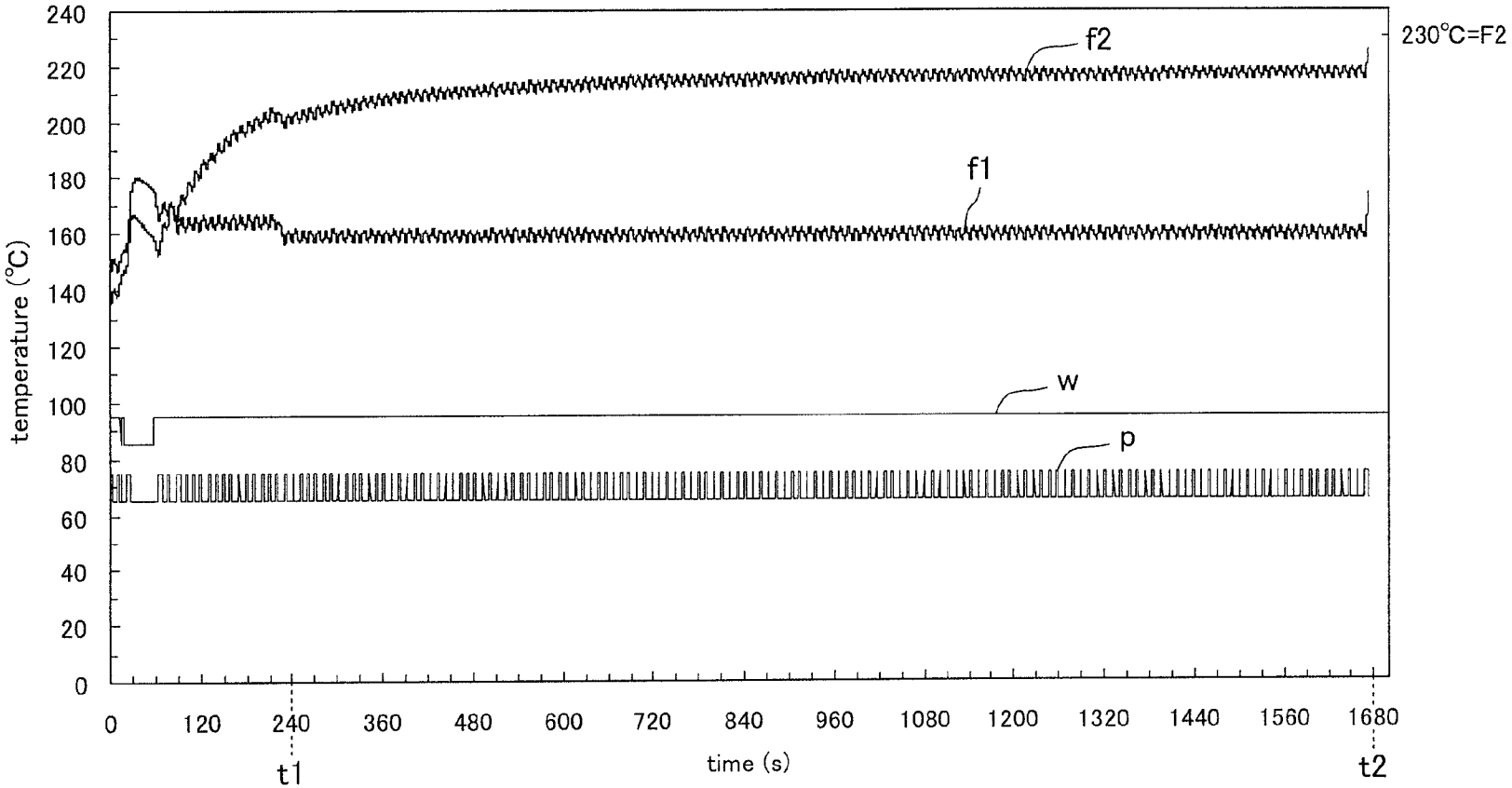
FIG. 6 is a graph showing an operational state of the fixing device obtained when the prescribed temperature of the fixing roller of when the energization control of the heater lamp is to be stopped is set appropriately and when all the recording papers are consecutively supplied from the paper feeding cassette in a full state and toner images on all the recording papers are fixed continuously.

FIG. 6 is a graph showing an operational state of the fixing device 5 obtained when 250 sheets of the largest sized recording papers are consecutively supplied from the paper feeding cassette 2 and toner images on all the recording papers are fixed continuously, and shows a characteristic f1 of the surface temperature of the smallest contact region Es of the fixing roller 11 detected by the first thermistor 21, a characteristic f2 of the surface temperature of the noncontact region D of the fixing roller 11 detected by the second thermistor 22, a power pulse signal p that is supplied from the heater power portion 23 to the heater lamp 16, and a drive signal w of the drive motor that drives the fixing roller 11 on the image forming apparatus 1 side.

In the graph in FIG. 6, paper feeding by the paper feeding cassette 2 and fixing by the fixing device 5 commence from a time t1, and paper feeding and fixing are completed at a time t2, and in the period from the time t1 until the time t2, the power pulse signal p is continuously outputted from the heater power portion 23 to the heater lamp 16, and the pulse width of the power pulse signal p is controlled such that the surface temperature of the smallest contact region Es of the fixing roller 11 detected by the first thermistor 21 is maintained substantially constant, and the surface temperature of the noncontact region D of the fixing roller 11 detected by the second thermistor 22 rises gradually to 220° C.

Accordingly, the temperature detected by the second thermistor 22 does not reach the prescribed temperature F2 until the fixing of all the recording papers supplied from the paper feeding cassette 2 in a full state is completed, and thus fixing of the recording papers can continue without any stopping of the energization control of the heater lamp 16. Thus, it can be said that the prescribed temperature F2 of when to stop the energization control of the heater lamp 16 is set to a temperature that is favorable to image forming operations of the image forming apparatus 1.

Furthermore, even though the temperature detected by the second thermistor 22 reaches the prescribed temperature F2 and energization control of the heater lamp 16 is stopped after the fixing of all the recording papers supplied from the paper feeding cassette 2 in a full state has been completed, at this time there is a necessity to refill recording papers into the paper feeding cassette 2 and the surface temperature of the fixing roller 11 drops during this refilling operation, and therefore fixing of recording papers can recommence immediately after this refilling operation has been completed.

Further still, it is preferable that even if the energization control of the heater lamp 16 has been stopped, the drive signal w of the drive motor is caused to continue for keeping the fixing roller 11 driving such that the fixing roller 11 and the pressure roller 12 continue to rotate. In this case, a flow of air is produced around the rollers 11 and 12, and the surface temperatures of the rollers 11 and 12 drop swiftly due to this flow of air such that the fixing of recording papers can recommence reliably.

Figure 7:
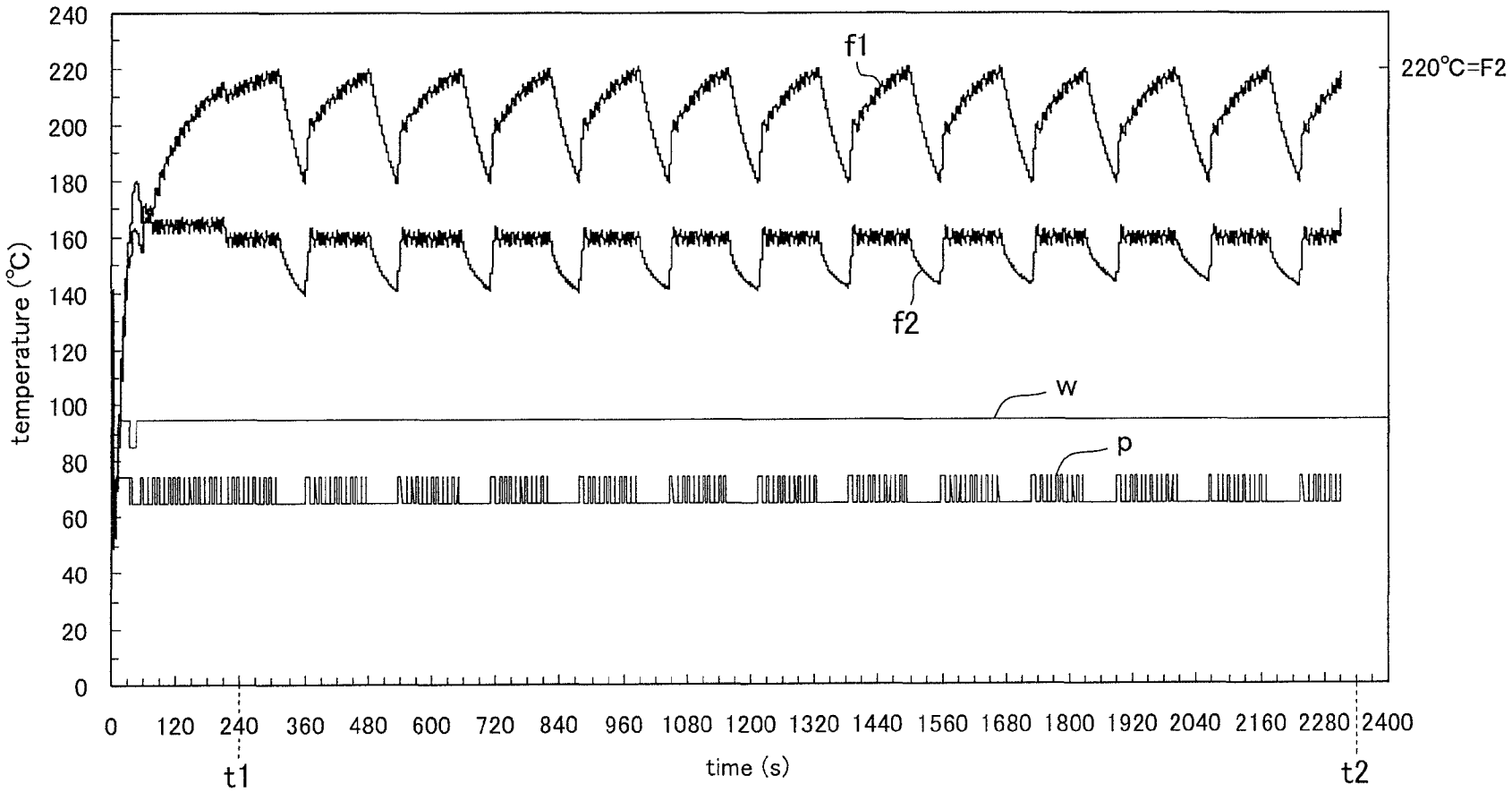
FIG. 7 is a graph showing an operational state of the fixing device obtained when the prescribed temperature of the fixing roller of when the energization control of the heater lamp is to be stopped is set low and when all the recording papers are consecutively supplied from the paper feeding cassette in a full state and toner images on all the recording papers are fixed continuously.

FIG. 7 shows the characteristic f1 of the surface temperature of the smallest contact region Es of the fixing roller 11 detected by the first thermistor 21, the characteristic f2 of the surface temperature of the noncontact region D of the fixing roller 11 detected by the second thermistor 22, the power pulse signal p that is supplied from the heater power portion 23 to the heater lamp 16, and the drive signal w of the drive motor that drives the fixing roller 11 on the image forming apparatus 1 side, which are obtained under equivalent conditions to the graph in FIG. 6, that is, conditions in which 250 sheets of the largest sized recording paper are supplied consecutively from the paper feeding cassette 2 and the toner images on all the recording papers are fixed continuously by the fixing device 5 and when the prescribed temperature F2 is set to the above-mentioned temperature that is reached (for example, 220° C.).

As is evident from the graph in FIG. 7, in a case where the prescribed temperature F2 is set to the above-mentioned temperature that is reached, in the interval until the fixing of all the recording papers supplied from the paper feeding cassette 2 in a full state is completed, the temperature detected by the second thermistor 22 repetitively reaches the prescribed temperature F2 multiple times, and each time this happens, the energization control of the heater lamp 16 is stopped. For this reason, the surface temperature of the smallest contact region Es of the fixing roller 11 detected by the first thermistor 21 becomes unstable, and the recording papers cannot be fixed continuously. That is, the image forming apparatus 1 or the fixing device 5 loses the capability of being able to continuously fix all the recording papers of the paper feeding cassette 2 in a full state.

The present invention can be embodied and practiced in other different forms without departing from the spirit and essential characteristics thereof. Therefore, the above-described working examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A fixing device comprising:

a fixing roller;

a single heating member that heats the fixing roller;

a pressure roller that is pressed against the fixing roller;

a first temperature detecting element that detects a temperature of a contact region, of the fixing roller, with which smallest sized paper used comes into contact; and a second temperature detecting element that detects a temperature of a noncontact region, of the fixing roller, that is outside a region with which largest sized paper used comes into contact, wherein energization control of the heating member is carried out based on a temperature detected by the first temperature detecting element, and energization control of the heating member is stopped when a temperature detected by the second temperature detecting element reaches a prescribed temperature, the fixing device further comprising a conduction shutoff portion that, in a case where the temperature of the contact region of the fixing roller has reached an upper limit temperature that is higher than the prescribed temperature, senses the upper limit temperature and shuts off the energization of the heating member, wherein, in a state in which a center position of the paper in an axial direction of the fixing roller has been aligned with a reference position of the fixing roller, the paper is transported sandwiched between the fixing roller and the pressure roller, and the first temperature detecting element and the conduction shutoff portion are arranged separated by a predetermined distance in a longitudinal direction along the axis of the fixing roller in a symmetrical manner with respect to the reference position.

2. The fixing device according to claim 1, wherein the conduction shutoff portion is a thermostat inserted to a power line of the heating member.

3. The fixing device according to claim 1, wherein a softening temperature or a melting temperature of a shaft bearing of the fixing roller is equal to or less than the upper limit temperature and higher than the prescribed temperature.

4. An image forming apparatus, comprising:

a fixing device that includes a fixing roller, a single heating member that heats the fixing roller, a pressure roller that is pressed against the fixing roller, a first temperature detecting element that detects a temperature of a contact region, of the fixing roller, with which smallest sized paper used comes into contact, and a second temperature detecting element that detects a temperature of a non-contact region, of the fixing roller, that is outside a region with which largest sized paper used comes into contact, and in which energization control of the heating member is carried out based on a temperature detected by the first temperature detecting element, and energization control of the heating member is stopped when a temperature detected by the second temperature detecting element reaches a prescribed temperature; and a paper feeding cassette that accommodates a specific number of sheets of paper to be in a full state, wherein a toner image is formed on paper supplied from the paper feeding cassette, and heat and pressure are applied to the paper by the fixing device such that the toner image is fixed to the paper, and wherein a temperature higher than a temperature reached at the noncontact region of the fixing roller when, while energization control of the heating member is maintained, the toner images on the specific number of sheets of paper supplied consecutively from the paper feeding cassette are fixed continuously is set as the prescribed temperature of when energization control of the heating member is to be stopped.

5. The image forming apparatus according to claim 4, wherein, after the energization control of the heating member has been stopped, a transport operation of paper by the fixing roller and the pressure roller continues.

6. The fixing device according to claim 2, wherein a softening temperature or a melting temperature of a shaft bearing of the fixing roller is equal to or less than the upper limit temperature and higher than the prescribed temperature.

* * * * *